US005775305A

United States Patent [19]

Bolger

[11] Patent Number: 5,775,305

[45] Date of Patent: Jul. 7, 1998

[54] FUEL PUMP INJECTOR FOR COMPRESSION IGNITION ENGINES

[76] Inventor: Stephen R. Bolger, 127 W. 79th St., Apartment 11 J, New York, N.Y. 10024

[21] Appl. No.: 851,664

[22] Filed: May 6, 1997

[51] Int. Cl.[6] ..... F02M 37/04; F04B 17/00

[52] U.S. Cl. ..... 123/497; 417/380

[58] Field of Search ..... 123/495, 497; 417/380, 381, 382; 239/87, 88, 96

[56] References Cited

U.S. PATENT DOCUMENTS

| | | | |
|---|---|---|---|
| 2,572,118 | 10/1951 | Dickson | 239/87 |
| 4,141,675 | 2/1979 | O'Neill | 417/380 |
| 4,197,996 | 4/1980 | Giardini | 239/87 |
| 4,247,044 | 1/1981 | Smith | 239/87 |
| 4,306,680 | 12/1981 | Smith | 239/87 |
| 4,473,340 | 9/1984 | Walsworth | 417/380 |
| 5,067,467 | 11/1991 | Hill et al. | 417/380 |
| 5,685,272 | 11/1997 | Paul et al. | 123/497 |

*Primary Examiner*—Thomas N. Moulis
*Attorney, Agent, or Firm*—Samuels, Gauthier, Stevens & Reppert

[57] ABSTRACT

A fuel pump injector for a reciprocating engine having a piston and combustion chamber. The injector comprises a housing having a driving piston slidably received therein. The driving piston is responsive to the pressure in the combustion chamber. A driving cylinder of fuel interfaces with the driving piston and holds the driving piston in place by static pressure. A second smaller diameter driven cylinder of fuel is responsive to the pressure of the driving cylinder. The driving piston statically pressurizes the driving cylinder during the engine's compression stroke. A valve releases the pressure from the driving cylinder to effect fuel injection by transferring the force on the driving piston onto the smaller diameter driven cylinder which injects the atomized fuel into the combustion chamber where it ignites.

14 Claims, 2 Drawing Sheets

FUEL PUMP INJECTOR FOR COMPRESSION IGNITION ENGINES

FIELD OF THE INVENTION

A fuel pump injector for compression ignition engines.

BACKGROUND OF THE INVENTION

Diesel engines conventionally employ a mechanical variable displacement fuel injection pump driven by a shaft. The fuel injection is governed by mechanical means to generate metered high pressure pulses of fuel to separate fuel injectors located in each cylinder. High pressure tubing connects each of the injectors separately to a centralized pump. These mechanical means are generally incompatible with electronic control methods which have so much improved the performance of gasoline (spark ignition) engines in recent years.

The present invention embodies a fuel pump injector with an electrical interface which allows direct computer control of all features of the diesel cycle fuel injection process and brings all the same performance advantages to compression ignition engines as have been demonstrated in spark ignition engines.

The fuel pump injector of the invention combines the functions of a fuel pump and a fuel injector in a compact device that replaces the conventional injector. It connects with low pressure tubing to a fuel tank, from which it can pump its own fuel. It communicates with a control module which creates a pulse train which the injector converts to precise spurts of atomized fuel.

The invention broadly comprises a solenoid actuated hydraulic amplifier fuel injector which delivers the atomized fuel. The amplifier derives the high energy needed to create an atomized fuel jet from the high pressure present in the engine cylinder at the moment of injection. It accepts electrical pulses from the control module to deliver metered pulses of fuel directly into the cylinders of compression-ignition engines in timed sequence.

In a preferred embodiment, the invention comprises a fuel pump injector for a reciprocating engine having a piston and a combustion chamber. The injector comprises a housing having a driving piston slidably received therein. The driving piston is responsive to the pressure in the combustion chamber. A driving cylinder of fuel interfaces with the driving piston and holds the driving piston in place by static pressure. A second, smaller diameter, driven cylinder of fuel is responsive to the pressure of the driving piston. The driving piston statically pressurizes the driving cylinder during the attached engine's compression stoke. A valve releases the pressure from the driving cylinder to effect fuel injection by transferring all of the force on the driving piston onto the smaller diameter driven cylinder which injects the atomized fuel into the combustion chamber where it ignites. A control module effects the movement of the driving piston via the valve based on the duty cycle of the engine.

DESCRIPTION OF THE PREFERRED EMBODIMENT(S)

Figure 1:
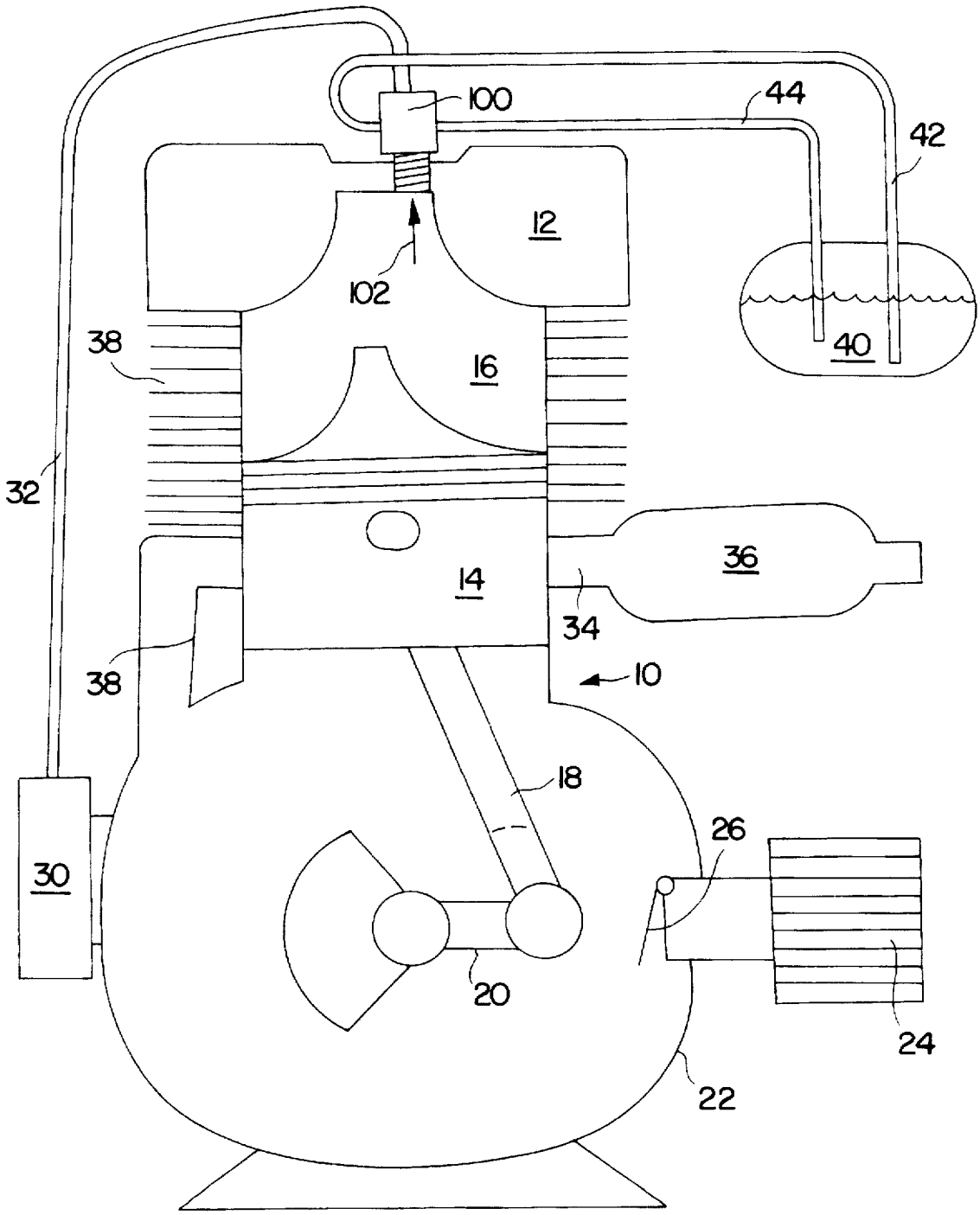
FIG. 1 is an illustration of a fuel pump injector embodying the invention in a diesel engine.

FIG. 1 shows an injector 100 of the invention installed on a conventional two stroke port valved crankcase scavenged piston engine 10 such as those used in lawn mowers, outboard motors and the like. The engine 10 is designed to have a sufficient compression ratio, typically 18:1 or more, to provide for compression ignition of an atomized fuel jet 102 emanating from the injector 100, installed in place of the usual spark plug. The engine 10 comprises a cylinder head 12 and a piston 14 which reciprocates in a cylinder 32. The piston 14 is driven by a connecting rod 18 and a crankshaft 20, the crankshaft mounted for rotation in a crankcase 22.

Air enters the engine 10 via a filter 24 through a check valve 26 into the crankcase as the piston 14 ascends. The air already in cylinder 16 is meanwhile compressed. A control module 30 detects top dead center of the piston 14 with a pressure sensor (not shown) integral with the fuel injector 100 via a cable 32. The module 30 then energizes a solenoid (not shown) in the injector 100 for the duration called for by the speed and load on the engine. When the piston 14 nears the bottom of its stroke, a port valve 34 allows for the exhaust of combusted gas through a muffler 36. At the bottom of the stroke, a port valve 38 opens to allow the lightly pressurized air in the crankcase 22 to blow freshly into cylinder 16, the crown on piston 14 diverting the flow to improve scavenging. Waste heat dissipates via fins 38. The fuel injector 100 draws fuel from a tank 40 through an intake hose 42. During the period of injection, the injector 100 hydraulically converts some of the enthalpy in the gas contained in the pressurized cylinder 16 into the kinetic energy of the injected fuel 102. This process produces a liquid fuel discharge which returns to the tank via return hose 44.

Figure 2:
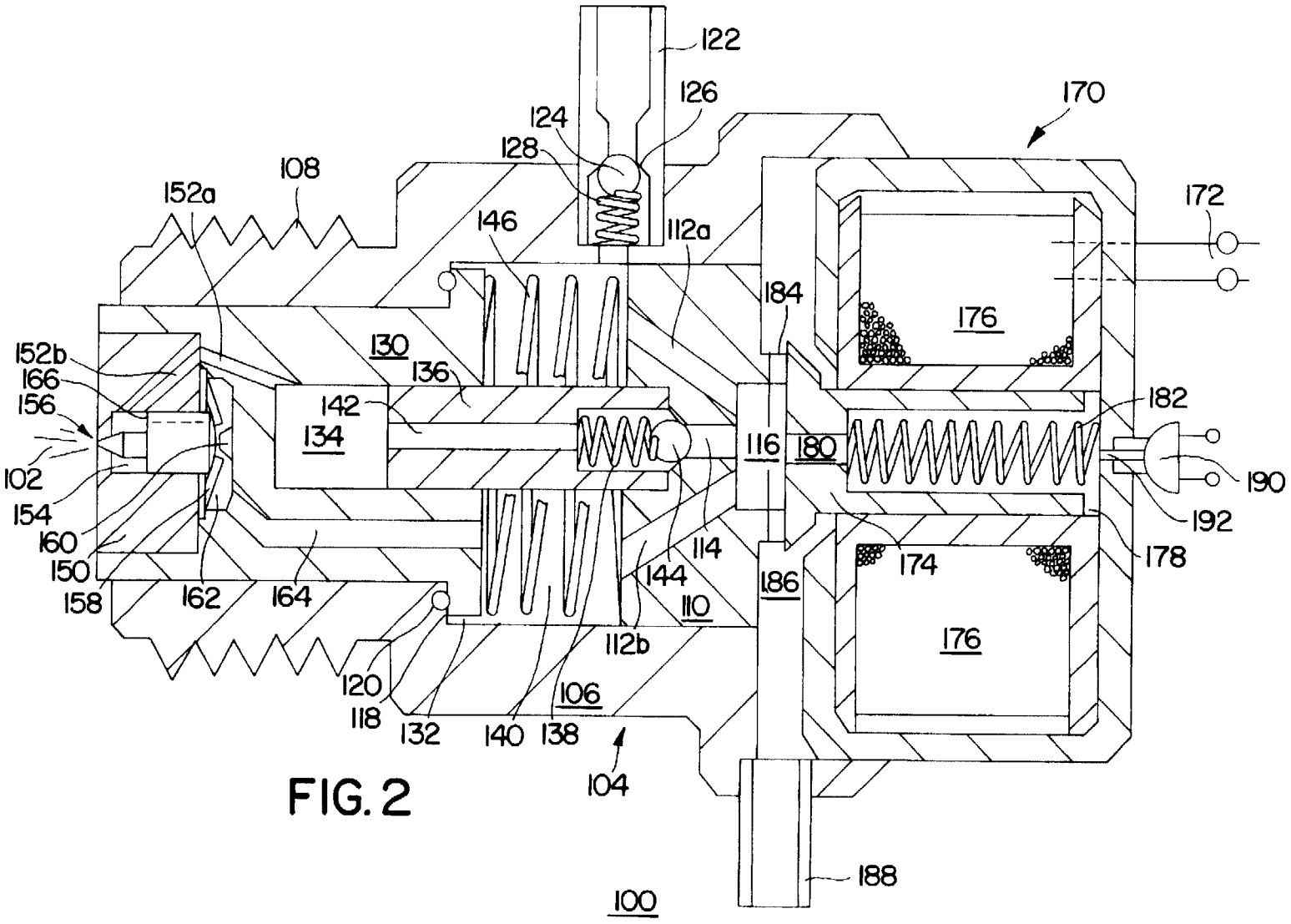
FIG. 2 is a sectional view of the injector of FIG. 1.

The injector 100 is shown in greater detail in FIG. 2. All internal components are shown contained within a housing 104 and a solenoid 170. The housing 104 is a generally cylindrical sleeve-like housing having an upper portion 106 and a lower threaded portion 108. The threads allow the injector 100 of the invention to be inserted into the cylinder head 12 in the manner of a spark plug.

Staked in the upper portion 106 of the housing 104 is a seat block 110. The seat block 110 is characterized by passages **112*a*, 112*b*, a recharge port 114 and a control port 116**.

The inner surface of the housing is characterized by a stepped surface 118 having a O-ring 120 received therein.

An intake port 122 is received in the upper portion 106. A ball 124 is biased against a seat 126 by a spring 128.

A hydraulic amplifier driving piston 130 is slidably received in the housing 104 and is characterized by a flange 132 which engages the O-ring 120. A driven pump cylinder 134 is formed in the driving piston 130 and has slidably received therein a driven piston 136. A passage 142 is also formed in the driven piston 136. A passage **152*a* is also formed in the driving piston 130. A spring 138 at one end is seated in the piston 136 and at the other end biases a ball check 144 on the recharge port 114. The seat block 110, the inner surface of the upper portion 106 and the driving piston 130 define a driving pump cylinder 140. A spring 146 biases the driving piston 130 away from the seat block 110**.

A mounting block 150 is secured in the lower end of the driving piston 130. The block 150 has a passage **152*b* which communicates with a chamber 154. A needle valve 156 is secured in the block 150. A wafer spring 158 biases the valve 156 to a closed position. A stop 160 limits the travel of the valve 156. A leak-off chamber 162 discharges fuel via a passage 164 back to a leak-off channel 166**.

The solenoid 170 is secured to the housing 104 in a rigid fluid tight manner. The solenoid 170 has contacts 172, an armature 174, and a coil 176. The armature 174 has formed therein a balance chamber 178 and a through passage 180. A spring 182 secured in the chamber 178 biases the armature 174 to a closed position against a valve seal 184. A discharge passage 186 communicates with a discharge port 188. A pressure sensor 190 reads pressure through a port 192.

In the operation of the invention, fuel enters the injector 100 via the intake port 122. The intake hose 44, FIG. 1, connects to the intake duct 122. The ball 124 held on the seat 126 ensures that fuel can only enter the driving pump cylinder 140 via the port 122.

During initial fueling, all internal volumes are purged to contain only liquid fuel. These volumes include: passages 112*a* and 112*b* communicating with the control port 116; the port 114, passages 152; the driving pump cylinder 140; the driven pump cylinder 134; the nozzle chamber 154; the nozzle leak-off chamber 162 and the discharge passage 164. Also containing only liquid fuel are the port 180; the pressure balance chamber 178; and the discharge duct 186 connecting to discharge port 188 through which fuel returns via the return hose 42, FIG. 3, to the tank 40.

The injector 100 converts pressure energy into a very high pressure injection atomized fuel 102 via the movement of the hydraulic amplifier driving piston 130. The driving piston 130 is held in place in the position as shown in FIG. 2 as pressure builds during the engine's compression stroke by the incompressible volume of liquid contained in the driving pump cylinder 140 and the various communicating volumes.

The injection process begins when the solenoid 170 is energized by the control electronics via contacts 172. This pulls the armature 174 against the spring 182, opening the flow path around the valve seal 184 from the control port 116 to the discharge duct 186. The armature 174 is formed as a piston sliding in a cylinder in the coil 176. The piston 174 (cylinder) is made the identical diameter as the diameter of the sealed area of the control port 116. A pressure balance between balance chamber 178 and the control port 116 is maintained via port 180. This feature assures that the force exerted by the spring 182 determines the pull-in force required of the solenoid 170 regardless of the engine's operating condition, and allows the use of modestly strong springs and solenoids regardless of the engine's operating condition.

When solenoid 170 opens the control port 116, the pressure of the liquid fuel in driving pump cylinder 140, which had until then been equal to that of the gas in the engine's cylinder, immediately falls close to the atmospheric pressure of the fuel in the tank as fuel begins to flow through passages 112*a* and 112*b* out of driving pump cylinder 140, through port 116 and eventually out exit port 188 from which it returns to the tank via a rubber hose. This leaves all the force of the engine cylinder's gas bearing on the fuel contained in the driven pump cylinder 134 and the various communicating passages. Its pressure then rises almost instantly to a multiple of the engine cylinder pressure. This multiple is selected by adjusting the relative diameters of driving piston 130 and driving pump cylinder 140. A multiplying factor or gain on the order of 6:1 is generally adequate. This ratio boosts the 1000 psi typically present in the cylinder of a compression ignition engine during the injection period to 6000 psi in the driven pump cylinder 134. The net 5000 psi available for injection produces near perfect atomization at the nozzle.

As the driving piston 130 begins to move under engine cylinder pressure, the driven piston 136 remains fixed in the block 110. The fuel contained in driven pump cylinder 134 is prevented from exiting via port 114 by ball check 144 held by the spring 138. The fuel can only exit to the nozzle chamber 154 via the passages 152. When this 5000 net psi pulse hits needle valve 152, it is forced back against wafer spring 158 until restrained by stop 160, opening nozzle 156 and creating the injection pulse 102 as the 5000 psi fuel escapes to the cylinder of the engine. This continues as long as the control port 116 is open, or the driving piston 130 runs out of stroke. However, control port 116 is always closed by the controller long before the piston runs out of stroke.

During the injection, some fuel will inevitably leak around the needle valve 152 into the leak-off chamber 162. The passage 164 allows this leakage to return to the driving pump cylinder 140 at low pressure. This leakage is beneficial because it provide an escape path to prevent weeping of fuel from the nozzle during the compression stroke of the engine as the pressure comes on the driving piston 130. In addition, the calibrated leak-off hole 166 reduces the capacity of a standard sized device for use in smaller engines.

The volume of fuel injected is determined by the duration of time that the control port 116 remains open. When the controller 30 determines that adequate fuel has been injected to sustain the load on the engine, it ends the injection by de-energizing the solenoid 170 which releases the armature 174 and closes the control port 116 by the action of the spring 182. Flow out of the driving pump cylinder 140 stops, stopping the movement of the driving pump cylinder 140. The building pressure conveyed to the leak-off chamber 162 via the passage 164 slams shut the needle valve 156, aided by the wafer spring 158, to end the injection promptly. The pressure balance between the balance chamber 178 and the control port 116 then returns to the static condition.

At the completion of the expansion cycle in the combustion chamber, the pressure falls enough to allow return spring 146 to drive driving piston 130 back to its starting position, with its movement limited by the seating of the flange 132 on the O-ring 120. This O-ring 120 sealing arrangement, and the effect of spring 138, combine to prevent fuel from leaking out of the injectors when the attached engine is shut down. As driving piston 130 returns, fresh fuel recharges the driving pump cylinder 140 past the ball check 124. The driven pump cylinder 134 simultaneously recharges through passage 114 with fresh fuel past ball-check 144 opening against the spring 138. When the driving piston 130 has returned to the position shown in the figure, the injector will be ready to fire again the next time the attached engine has completed a compression stroke.

Obviously, the control module can derive the necessary signals from the attached engine by a wide variety of established means. The injector of the invention allows one to easily attach a solid state pressure sensor 190 through port 192 to balance chamber 178 and measure the cylinder pressure in the attached engine, at least while control valve 116 is closed. One may take derivatives of this signal to detect top dead center and the ideal instant to begin injection. This makes the electronic control of small engines simple, rugged and inexpensive. Details of other electronic control algorithms lie outside the scope of this disclosure but are well within the skill of the art.

Obviously, many variations are possible to meet special needs in engines large or small or fast or slow. Two such obvious variations include the use of diaphragm seals in place of sliding seals in the driving and/or driven cylinders and the use of two stage or amplified solenoid valves in place of the pressure balanced solenoid valve illustrated in the preferred embodiment.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A fuel pump injector for a reciprocating engine having a piston and a combustion chamber comprising:

a housing having a driving piston slidably received therein, the driving piston in communication with the combustion chamber, a driving cylinder in pressure-exchange relationship with the piston, the driving piston statically pressurizing fuel in the driving cylinder during the engine's compression stroke, and a driven cylinder in pressure communication with the driving piston;

means for depressurizing the driving cylinder to transfer the pressure from the driving piston to the driven cylinder;

means for discharging atomized fuel from the driven cylinder into the combustion chamber;

means for introducing the fuel into the housing; and means for controlling the pressurizing and depressurizing of the fuel in the driving cylinder based on the duty cycle of the engine.

2. The injector of claim 1 wherein the housing comprises a seat block spaced apart from the driving piston and defining therebetween the driving cylinder and means for biasing the driving piston away from the seat block and said means for biasing extends from the seat block to the driving piston.

3. The injector of claim 2 wherein the driven cylinder is formed within the driving piston, the driven piston has one end seated in the seat block and extends through the driving cylinder and is slidably received in the driving piston and the other end of the driven piston interfaces with the driven cylinder whereby when the driving cylinder is depressurized there is relative movement between the driving piston and the driven piston which results in the discharge of fuel from the driven cylinder.

4. The injector of claim 1 comprising means for discharging the fuel from the injector, said means for discharging in fluid flow communication with the driving cylinder and wherein the means for depressurizing the driving cylinder comprises:

means for sealing the fuel in the driving cylinder during the engine's compression stroke and for flowing the fuel from the driving cylinder and through the discharge port when the driving cylinder is depressurized.

5. The injector of claim 4 wherein the means for sealing the discharge port comprises a solenoid actuated valve.

6. The injector of claim 5 wherein the means for controlling the pressurizing and depressurizing of the fuel in the driving cylinder controls the solenoid actuated value.

7. The injector of claim 5 wherein the solenoid valve is spring biased to a sealed position, the valve having a balance chamber formed therein, the balance chamber in communication with the fuel in the driving cylinder during the engine's compression stroke whereby the force exerted by the spring determines the pulling force required of the solenoid.

8. The injector of claim 4 wherein the means for sealing comprises a diaphragm seal.

9. The injector of claim 1 wherein the means for discharging the atomized fuel comprises a fuel injection chamber downstream of the driven cylinder and upstream of the combustion chamber.

10. The injector of claim 9 wherein the fuel injection chamber is formed in the lower portion of the driving piston.

11. The injector of claim 10 comprising means for returning at least a portion of the fuel from the fuel injection chamber to the driving cylinder.

12. The injector of claim 1 wherein the means for introducing fuel in to the housing comprises:

means for introducing fuel into the driving cylinder.

13. The injector of claim 12 wherein the means for introducing fuel into the driving cylinder comprises an inlet port.

14. The injector of claim 1 wherein the means for controlling the pressurizing and depressurizing of the fuel in the driving cylinder comprises:

means for detecting the pressure in the combustion chamber.

* * * * *